United States Patent [19]

Hart

[11] 4,230,140

[45] Oct. 28, 1980

[54] ENVIRONMENTAL FIRST STAGE SCUBA REGULATOR

[75] Inventor: Dennis L. Hart, Hacienda Heights, Calif.

[73] Assignee: Under Sea Industries, Inc., Compton, Calif.

[21] Appl. No.: 3,400

[22] Filed: Jan. 15, 1979

[51] Int. Cl.[3] ..... B63C 11/22

[52] U.S. Cl. ..... 137/81.2; 137/172; 137/505.25

[58] Field of Search ..... 137/81, 505.25, 172, 137/197, 199; 210/496, 510

[56] References Cited

U.S. PATENT DOCUMENTS

| | | | |
|---|---|---|---|
| 3,324,875 | 6/1967 | Anderson | 137/236 |
| 3,799,189 | 3/1974 | Christianson | 137/505.25 X |
| 3,920,033 | 11/1975 | Ferrando | 137/81 |
| 4,091,830 | 5/1978 | Hirs | 137/172 X |

*Primary Examiner*—Harold W. Weakley
*Attorney, Agent, or Firm*—Flam & Flam

[57] ABSTRACT

A first stage scuba regulator operates to supply breathable air at a pressure of say, about 125 psi above ambient to a second stage demand regulator. The first stage regulator includes a piston subjected on one side to ambient pressure, and on the other to downstream air pressure, and so arranged as to open when the ambient pressure overpowers downstream pressure by a preset amount determined by a bias spring and to close when downstream pressure rises to the present amount. Instead of directly conducting outside water to the first side of the piston, an inert barrier fluid of high molecular weight is used that fills the piston chamber. Low temperature silicone grease is the preferred material. The barrier fluid is retained by a porous closure that offers very limited restriction to the flow of water, but significantly greater resistance to the flow of the barrier fluid. The mechanism is protected from malfunction due to icing and is isolated from sand, silt, coral and other particulate matter having deleterious effects upon rubber seals and other parts of the mechanism.

6 Claims, 1 Drawing Figure

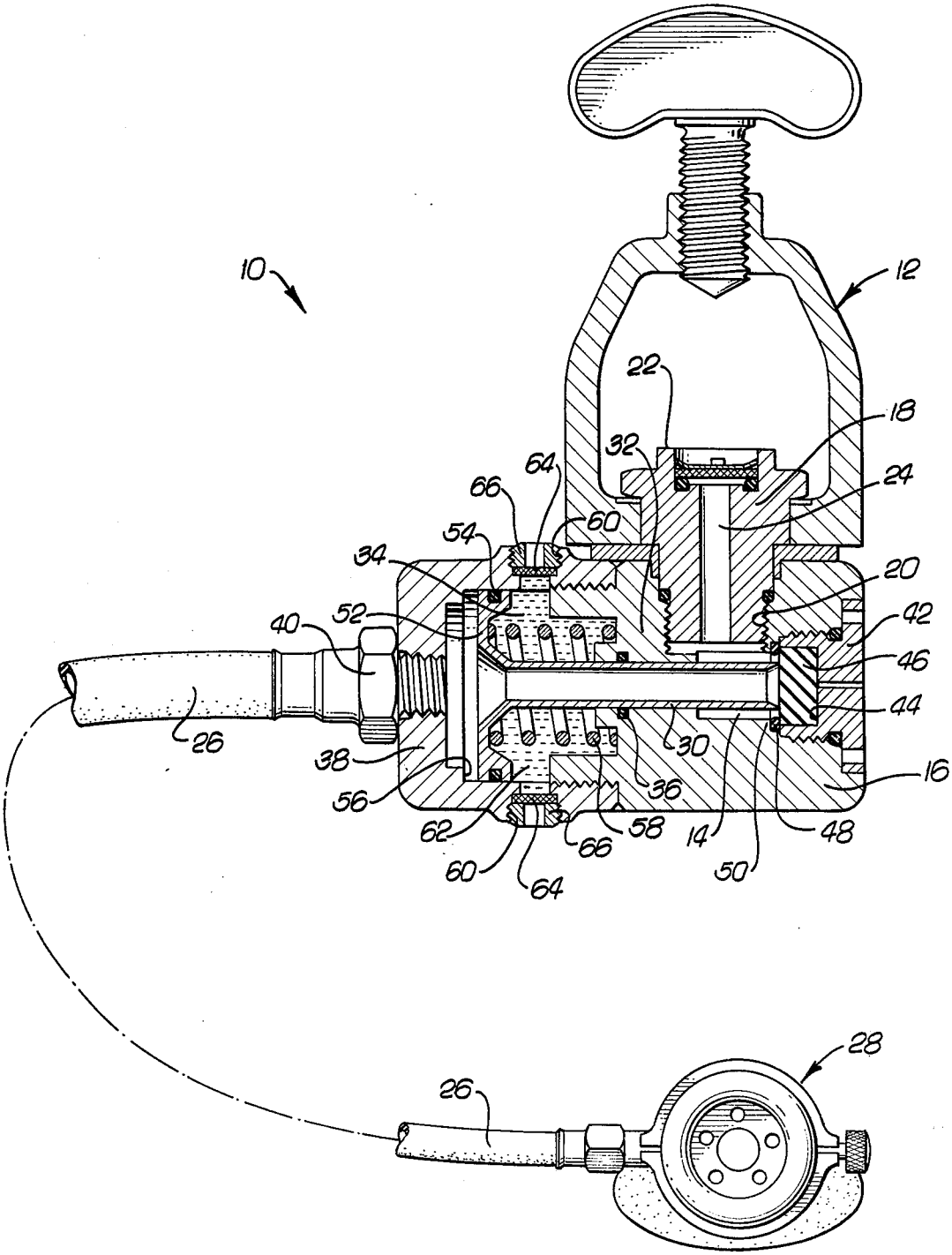
10
12
22
18
32
64
66
24
60
54
34
20
52
42
40
46
44
26
30
38
16
36
56
62
58
14
48
66
60
64
50
28
26

ENVIRONMENTAL FIRST STAGE SCUBA REGULATOR

FIELD OF INVENTION

This invention relates to scuba diving apparatus, and particularly, to a first stage regulator interposed between a tank of high pressure air and a second stage or demand regulator.

DESCRIPTION OF THE PRIOR ART

Demand breathing regulators are designed to operate efficiently when the supply pressure thereto is 125 pounds per square inch. A supply tank easily accommodates breathable gases to pressures of about 3,000 pounds per square inch. Accordingly, a first stage regulator is conventionally interposed between the tank and the demand regulator that reduces the tank pressure to the designed value.

One particularly successful first stage regulator utilizes a stainless steel piston having an integral hollow stem that extends through a partition wall and to a separate control chamber to which high pressure air is supplied. A knife edge formed at the end of the hollow stem engages and retracts from a seat in the control chamber to stop or permit flow of air through the stem to the outside of the piston chamber and, thence, to a hose connected to the demand regulator. The inner side of the piston chamber accommodates a bias spring and is open to the ambient water. The piston moves to seat the stem when the pressure of air in the outside piston chamber at least equals the pressure of water and the pressure produced by the bias spring. The piston moves to unseat the stem when the air pressure, due to diver demand, falls. To isolate the inside of the mechanism from the water of the inside piston chamber, one O-ring is provided at the peripheral wall of the piston and another is provided between the stem and the partition wall.

As simple as this structure is, there are problems. Ice may form in colder environments due to the refrigeration effect of the expanding air, causing critical malfunctions of the regulator. Sand, silt, coral and other particulate matter may enter to cause malfunctions and excessive wear of the O-rings, requiring frequent repair.

OBJECTIVE

The primary object of the present invention is to provide a simple first stage regulator in which the mechanism is entirely protected from the deleterious effects of ambient water and of particulate material carried thereby.

SUMMARY OF INVENTION

In order to accomplish the foregoing objective, I provide an inert barrier fluid in the piston chamber and conduct the ambient pressure thereto through a porous closure. The barrier fluid, such as silicone grease, maintains adequate fluidity at low temperatures. The barrier fluid has a relative high molecular weight and size so that it is retained in the piston chamber by the porous plug.

As the regulator cycles between open and closed position, the boundary between the barrier fluid and the ambient water shifts inwardly and outwardly at a place far removed from the internally situated mechanisms.

BRIEF DESCRIPTION OF THE DRAWING

A detailed description of the invention will be made with reference to the accompanying single figure, which is a longitudinal sectional view of a first stage diving regulator. The connecting hose and second stage regulator are shown in elevation.

DETAILED DESCRIPTION OF THE PREFERRED EMBODIMENT

The following detailed description is of the best presently contemplated mode of carrying out the invention. This description is not to be taken in a limiting sense, but is made merely for purposes of illustrating the general principles of the invention, since the scope of the invention is best defined by the appended claims.

The first stage regulator 10 includes a conventional yoke 12 designed to attach to the neck of a conventional tank valve (not shown). Air from the tank is conducted to a control chamber 14 located at the right hand end of the regulator body 16. For this purpose, a fitting 18 is provided that threadedly attaches to a lateral opening 20 of the body 16. The fitting 18 provides, at its outer end, a swivel attachment for the base of the yoke 12. The outer end of the fitting has a register 22 that interfits the tank valve and establishes a sealing relationship thereto. A passage 24 conducts pressurized air through the fitting and to the control chamber 14. Air from the control chamber 14 is conducted to the hose 26 for a second stage regulator 28 through a hollow stem 30 that extends through a partition wall 32 and into a piston chamber 34 at the left hand end of the regulator body 16. An O-ring 36 mounted by the wall 32 surrounds the hollow stem to provide an exterior seal therefor, preventing passage of fluid from the piston chamber 34 to the control chamber 14.

The piston chamber is closed by a cap 38 threadedly attached to the body. The center of the cap 38 has a threaded opening cooperable with a fitting 40 of the air hose 26. The control chamber is closed by a retainer 42 threadedly attached to the body 16. The retainer has a recess 44 that mounts a resilient seat 46 of generally cylindrical form. The rim of the seat is urged to seal against an O-ring 48 located at an intermediate shoulder 50.

The seat 46 is positioned to be engaged by a knife edge at the right hand end of the stem 30 thereby to close communication between the control chamber 14 and the hose 26. This occurs when the pressure of the breathable gas in the stem exceeds the ambient pressure by a predetermined amount. For this purpose, a piston 52 is provided. The piston 52 is attached to the left hand end of the stem 30. The rim of the piston 52 is slidable in a cylindrical bore of the cap 38. A seal therebetween is provided by an O-ring 54. A shoulder 56 in the cap prevents the piston 52 from bottoming against the cap. Accordingly, the left hand end of the piston is at all times in free communication with the interior of the stem 30 and with the air hose 26.

The piston is urged to the left to carry the stem 30 away from the seat 46 by two forces. One force is that provided by a compression spring 58 accommodated in the inner side of the piston chamber. The spring engages the underside of the piston 52 at one end, and the partition wall 32 at the other. The spring is stressed so that it exerts a positive force on the piston even at the limited position determined by the shoulder 56. The second force exerted on the piston that tends to unseat the stem is that provided by the ambient pressure acting over the effective area of the piston. For this purpose, the inner piston chamber is exposed to ambient pressure through openings 60 located in this instance on diametrically opposite sides of the body 16.

The pressure exerted by the spring over the effective area of the piston is approximately 125 pounds per square inch. Accordingly, if the pressure in the stem 30 and hose 26 drops below a value less than 125 pounds per square inch above ambient, the spring assisted by ambient pressure will move the piston away from seated position shown, thus to admit air from the control chamber 14 until the ambient pressure and spring pressure is counterbalanced, whereupon the piston will move the stem 30 to reseat. This well understood operation will supply reasonably regulated air to the hose 26 and the demand regulator 28.

The inner part of the piston chamber 34 is filled with a barrier fluid 62, in this instance, low temperature silicone grease having, relative to water, a very high molecular weight and a very substantial molecular size. The openings 60 are closed by porous plugs 64 retained by hollow rings 66 threadedly attached at the lateral openings 60.

The plugs may be made of powdered metal materials, compacted and fused so as to provide significant impedance to the flow of the barrier fluid while allowing free passage of water. Such materials are available, for example, from Asco Sintering Corp. of Los Angeles, California, and known commercially as sintered metal filters. Using silicone grease of the type available from Dow Corning Corp. of Midland, Mich., and known commercially as Dow Corning silicon lubricant, I prefer to provide a plug having an effective passage size of fifty (50) microns.

By using a spring of quite high constant, the range of movement of the stem 30 is small, and so also is the volumetric displacement of the piston between open and closed positions. At the closed position of the regulator shown, the boundary between the barrier fluid and water at the openings is preferrably just inside the plugs 64. As the piston moves to the left to open the valve, the water enters the piston chamber very slightly, only to be purged therefrom as the regulator closes. The barrier fluid is largely immiscible with the water. Consequently, the water never permeates the chamber and is largely confined to the region of the openings. The low porosity of the plugs 64 serves to retain the barrier fluid in the piston chamber, notwithstanding the fact that the regulator case may be subjected to various forces in handling and in use.

In order properly to locate the level of barrier fluid, the unit is filled while the unit is connected to a high pressure air source to close the regulator. Otherwise, the regulator will malfunction.

The seals 36 and 54 are very well isolated from the ambient water. Also isolated is the piston itself, the stem 30 and the opening through the partition in which the stem 30 works. Icing does not occur; the O-ring seals are protected from sand, silt, coral and other particulate matter whereby long reliable operation of the regulator is assured.

Intending to claim all novel, useful and unobvious features shown or described, I make the following claims:

1. In a first stage regulator for use with a high pressure source of breathable gases and a second stage demand regulator:

(a) a regulator body having a piston chamber;

(b) a piston in the chamber and slidable therein, said piston dividing said chamber into two sides;

(c) means forming an outlet from one side of the chamber;

(d) valve means operable upon movement of the piston into said one side for opening a passage for breathable gases from said high pressure source to said one side of said piston chamber and operable upon movement of the piston away from said one side for closing said passage;

(e) means forming an opening into the said other side of said piston chamber for exposing said other side of said piston chamber to ambient; the improvement which consists of:

(f) an inert barrier fluid in said other side of said piston chamber;

(g) a porous plug at said opening and having a porosity to inhibit outflow of said barrier fluid while permitting relatively free passage of water therethrough;

(h) said barrier fluid being substantially immiscible with water whereby water entering said other side of said piston chamber is isolated from said piston and associated parts thereof.

2. The regulator as set forth in claim 1 in which said barrier fluid has the characteristics of low temperature silicone grease having, relative to water, a high molecular weight and high molecular size.

3. The regulator as set forth in claim 1 in which the boundary between said barrier fluid and ambient water is located just inside said porous plug when said regulator is in its OFF position.

4. In a first stage regulator for use with a high pressure source of breathable gases and a second stage demand regulator:

(a) a regulator body having a piston chamber at one end and a control chamber at the other end separated by a partition wall;

(b) a piston in the piston chamber and dividing said chamber into an inner part and an outer part;

(c) an O-ring carried by the piston and isolating said chamber parts;

(d) a hollow stem attached to the piston and extending through said partition wall into said control chamber, said hollow stem at one end opening only to the outer part of said piston chamber, said stem having an edge at its other end;

(e) an O-ring carried at said partition wall and surrounding said stem to seal said piston chamber from said control chamber;

(f) means limiting outward movement of the piston to prevent its bottoming, whereby said piston is at all times subjected to the pressure of fluid in the hollow stem;

(g) a demand regulator hose attached to said body and in constant communication with said outer part of said piston chamber;

(h) means for conducting pressurized air to the control chamber at a place surrounding said stem;

(i) a seat opposed so said edge and operative to close communication between said control chamber and said hollow stem when said stem is moved to engage said seat by movement of said piston;

(j) a compression spring in said inner part of said piston chamber and urging said piston to its outer limit;

(k) means forming an opening through the regulator body to the inside part of said piston chamber; the improvement which consists of:

(l) an inert barrier fluid in said inside part of said piston chamber and substantially filling it;

(m) a porous plug at said opening and having a porosity to inhibit outflow of said barrier fluid while permitting relatively free passage of water therethrough;

(n) said barrier fluid being substantially immiscible with water whereby water entering said inner part of said piston chamber is isolated from said piston and said O-ring seals.

5. The regulator as set forth in claim 4 in which said barrier fluid has the characteristics of low temperature silicone grease having, relative to water, a high molecular weight and high molecular size.

6. The regulator as set forth in claim 4 in which the boundary between said barrier fluid and ambient water is located just inside said porous plug when said regulator is in its OFF position.

* * * * *